US005452846A

United States Patent [19]

Myers

[11] Patent Number: 5,452,846

[45] Date of Patent: Sep. 26, 1995

[54] CONTAINER WITH DECORATIVE DISPLAY AND CLOSURE SECUREMENT ASSEMBLY

[76] Inventor: Susan B. Myers, 3431 Cloudcroft Ct., Rocklin, Calif. 95765

[21] Appl. No.: 120,354

[22] Filed: Sep. 14, 1993

[51] Int. Cl.[6] ..... B65D 5/00

[52] U.S. Cl. ..... 229/116.3; 229/117.14; 229/125.37; 446/148; 446/152; D9/336

[58] Field of Search ..... 229/8, 922, 125.37, 229/125.38, 117.14; 40/312, 539; 206/459.5, 457; D9/336; 446/488, 148, 152

[56] References Cited

U.S. PATENT DOCUMENTS

| | | | |
|---|---|---|---|
| 890,135 | 6/1908 | Gilliland | 446/148 |
| 2,148,279 | 2/1939 | Sandberg | 40/539 X |
| 2,404,089 | 7/1946 | Pollock | 40/539 |
| 2,458,879 | 1/1949 | Schenk | 40/539 X |
| 2,696,690 | 12/1954 | Kellerer | 40/539 X |
| 3,035,363 | 5/1962 | Luchsinger | 446/148 X |
| 3,256,634 | 6/1966 | Mace | 446/151 X |
| 3,515,332 | 6/1970 | Smith . | |
| 4,201,331 | 5/1980 | Austin . | |
| 4,374,877 | 2/1983 | Cole . | |
| 4,700,831 | 10/1987 | Kassai | 229/117.14 X |
| 4,774,780 | 10/1988 | Crowell | 446/148 X |
| 4,784,314 | 11/1988 | Penick . | |
| 5,293,706 | 3/1994 | Wood | 446/148 X |

*Primary Examiner*—Allan N. Shoap
*Assistant Examiner*—Christopher J. McDonald
*Attorney, Agent, or Firm*—Thomas R. Lampe

[57] ABSTRACT

A decorative display assembly mounted on a container includes a support panel, a decorative object, and at least one actuating member. The support panel includes an outer portion having a slot defined therein and an inner portion underlying and extending generally parallel to the outer portion and along and below the slot defined therein. The container includes a closure and the actuating member can be attached to the container at a location spaced from the decorative object to secure the closure in closed condition.

16 Claims, 11 Drawing Sheets

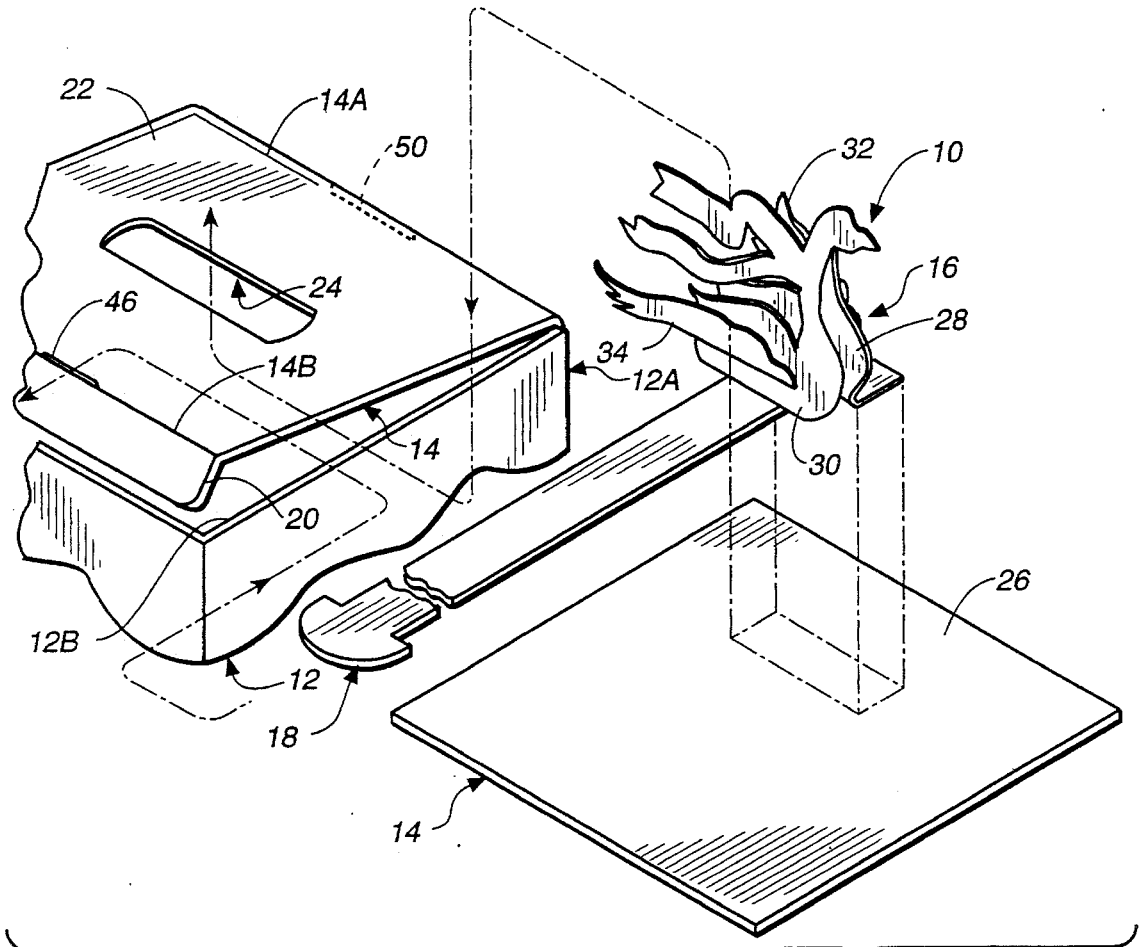
FIG._6 FIG._5
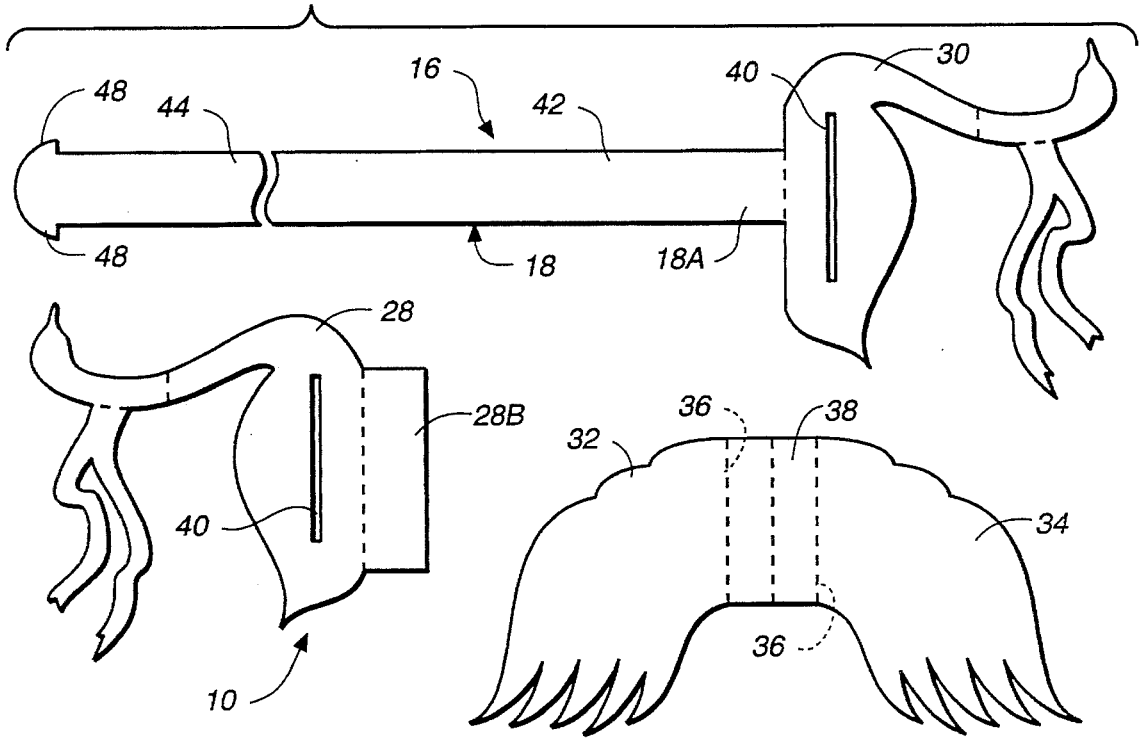

CONTAINER WITH DECORATIVE DISPLAY AND CLOSURE SECUREMENT ASSEMBLY

TECHNICAL FIELD

The present invention generally relates to a container, such as a gift box, incorporating a decorative display assembly utilized to secure a container closure in closed condition.

BACKGROUND ART

A variety of gift boxes are typically used to package gifts for special occasions, such as holidays, birthdays, anniversaries and the like. Decorative ornaments and attachments are well-known in the prior patent art for use on such gift boxes. The use of such decorations is intended to obviate the need to have the box separately gift-wrapped.

Representative examples of such decorations are disclosed in U.S. Pat. No. 3,515,332, issued Jun. 2, 1970 to Smith, U.S. Pat. No. 4,201,331, issued May 6, 1980 to Austin, U.S. Pat. No. 4,374,877, issued Feb. 22, 1983 to Cole, and U.S. Pat. No. 4,784,314, issued Nov. 15, 1993 to Penick.

The Smith patent discloses a container having a top closure with a pair of paperboard flaps which coact with each other to provide a three-dimensional representation of a given subject. The Austin patent discloses a carton having a top portion provided with butterfly wing shaped tabs which are maintained at an angle relative to the top of the carton to create an alleged aesthetically pleasing design. The Cole patent discloses a decoration adapted to automatically expand or pop-up to an upstanding orientation from a compact folded orientation for use in gift-wrapping a package. The Penick patent discloses a gift box having a separate design panel hingedly attached to one of the box panels which stands apart from the box itself for display on the exterior of the box.

These prior art patents collectively represent a step in the right direction toward obviating the need to have the box separately gift-wrapped. However, the particular designs of the decorations of these patents appear to fall short from both aesthetic and functional standpoints of providing a pleasing appearance which is equivalent to a box gift-wrapped with wrapping paper and the like. Consequently, a need still exists for a more pleasing and unique decoration for a gift box. Furthermore, the decorative features of the prior art arrangements do not perform the meaningful functional task of securing the box closed.

DISCLOSURE OF INVENTION

The present invention provides an erectable decorative display assembly for a gift box or the like designed to satisfy the aforementioned needs. The decorative display assembly of the present invention eliminates the requirement for any additional tools or materials, such as scissors, tape, bow, ribbon or wrapping paper to wrap the gift box. The decorative display assembly in combination with a decorated gift box makes it easier to produce a gift-wrapped package by requiring less skill and time to erect and close the decorated box and then erect the decorative display assembly. Importantly, the display assembly of the present invention also functions to secure the box in closed condition.

The present invention incorporates a decorative display assembly for mounting on a box and the like. The decorative display assembly comprises: (a) a support panel provided as a portion, such as a top closure, of the box; (b) at least one decorative object mounted on the support panel for undergoing movement between folded and erected conditions; and (c) at least one actuating member connected to a portion of the decorative object and coupled to the support panel for undergoing movement relative thereto to cause moving of the decorative object between the folded and erected conditions relative to the support panel. The actuating member is cooperable with other structural elements to secure the box in closed condition after the decorative object has been erected.

The support panel includes an outer portion having slot defined therein and an inner portion underlying and extending generally parallel to the outer portion and the slot defined in the outer portion of the support panel along a lower side of the slot. The decorative object includes at least a pair of substantially flat members being connected together at respective upper portions thereof. One of the flat members is connected at a lower edge to the support panel adjacent to a first interior edge portion of the outer portion of the support panel defining a first side of the slot. The other of the flat members is connected at a lower edge to an end portion of the actuating member and movable toward and away from a second interior edge portion of the outer portion of the support panel defining a second side of the slot being opposite from the first side thereof.

The actuating member is an elongated push-pull member which extends and is slidably mounted between the outer and inner portions of the support panel. The actuating member also extends outwardly from between the outer and inner portions of the support panel through a slit defined in a peripheral edge portion of the support panel. By pulling on the actuating member, the decorative object is converted from the folded condition, in which the object rests in a collapsed configuration on the support panel, to an erected condition, in which the object is expanded and disposed generally upright, protruding outwardly from the support panel. By pushing on the actuating member, the decorative object can be converted from the erected condition back to the folded condition.

The actuating member, which may, for example, be in the form of a strip, after being utilized to move the decorative object to the erected condition, is secured to the container at a location spaced from the decorative object to maintain the decorative object in erected condition and to secure the container or box in closed condition.

Other features, advantages, and objects of the present invention will become apparent with reference to the following description and accompanying drawings.

BRIEF DESCRIPTION OF DRAWINGS

FIG. 5 is an exploded, perspective view of the decorative assembly;

FIG. 6 illustrates the decorative object flattened condition;

MODES FOR CARRYING OUT THE INVENTION

Figure 1:
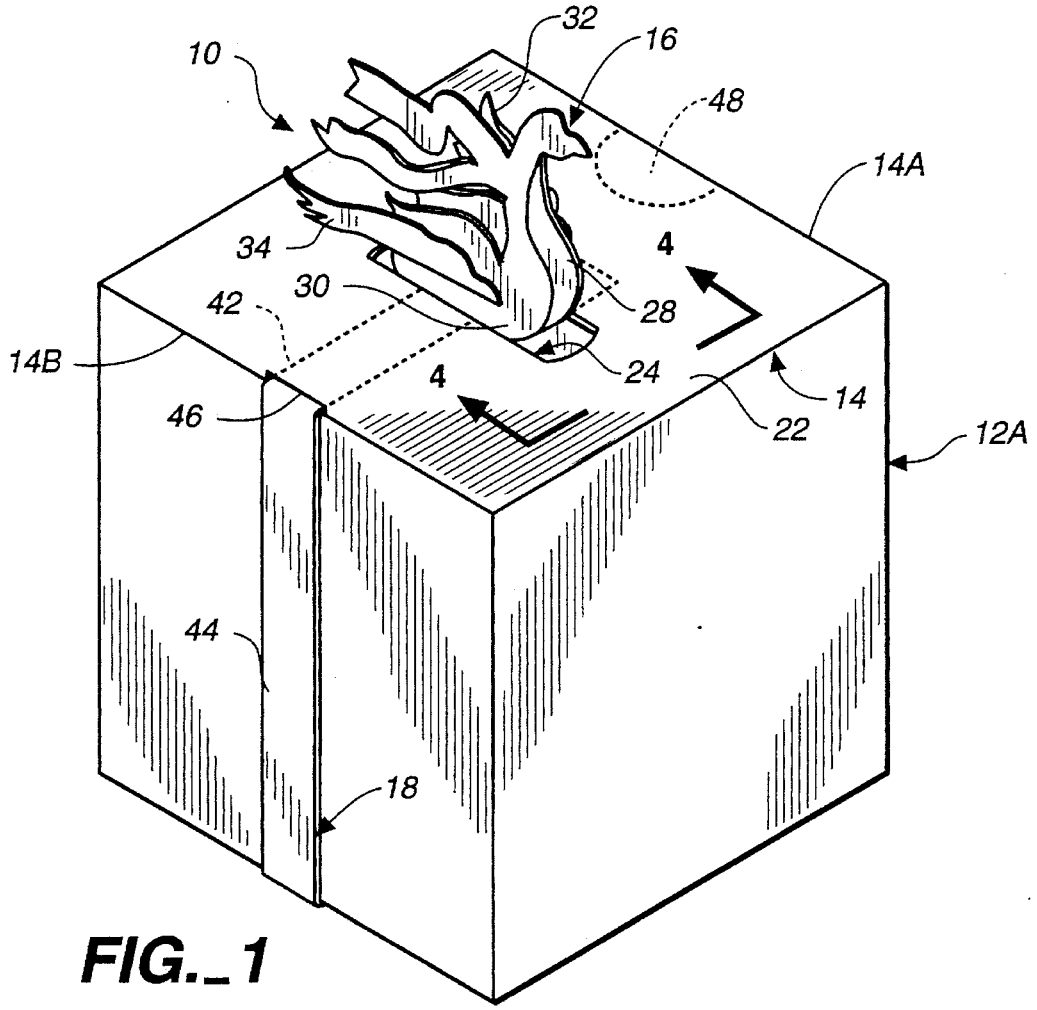
FIG. 1 is a perspective view of a container with a decorative display and closure securement assembly constructed in accordance with the teachings of the present invention and a decorative object disposed in an erected condition.

Referring to FIGS. 1–6 of the drawings, there is illustrated an erectable decorative display assembly of the present invention, generally designated 10 mounted on a container 12, such as a gift box and the like. Basically, the decorative display assembly 10 includes a support panel 14, at least one decorative object 16 and at least one actuating member 18. The support panel 14 is provided as a portion of the top closure of the container 12. The decorative object 16 is mounted on the support panel 14 so as to be capable of undergoing movement between erected and folded conditions relative to the support panel 14, as shown respectively in FIGS. 1 and 2. The actuating member 18 is the form of an elongated push-pull member 18 of sheet material such as paperboard being connected to a portion of the decorative object 16 and coupled to the support panel 14 so as to be capable of undergoing movement relative thereto to cause movement and conversion of the decorative object 16 between the folded and erected conditions.

Figure 2:
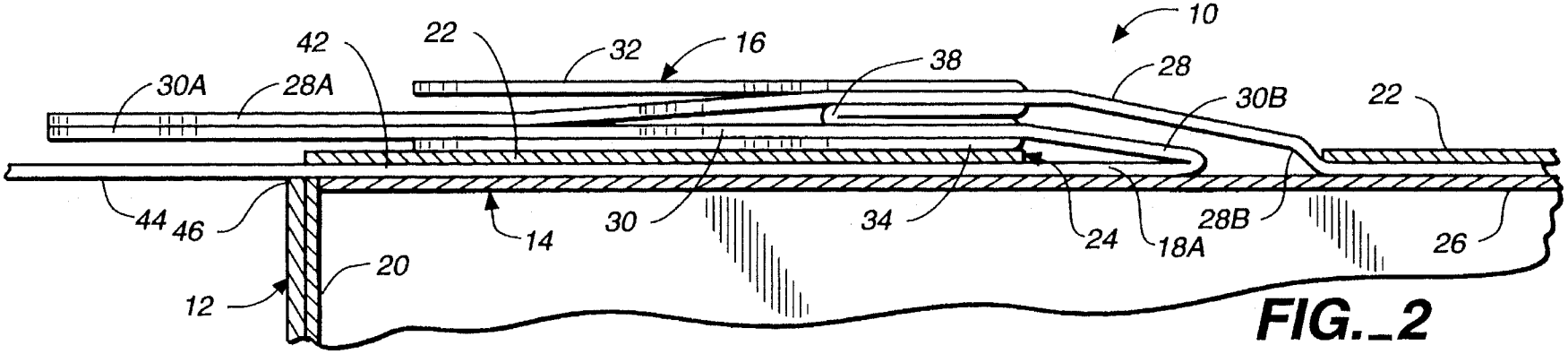
FIG. 2 is an enlarged, side elevational view of a portion of the container with the decorative display assembly shown disposed in a folded condition.
Figure 3:
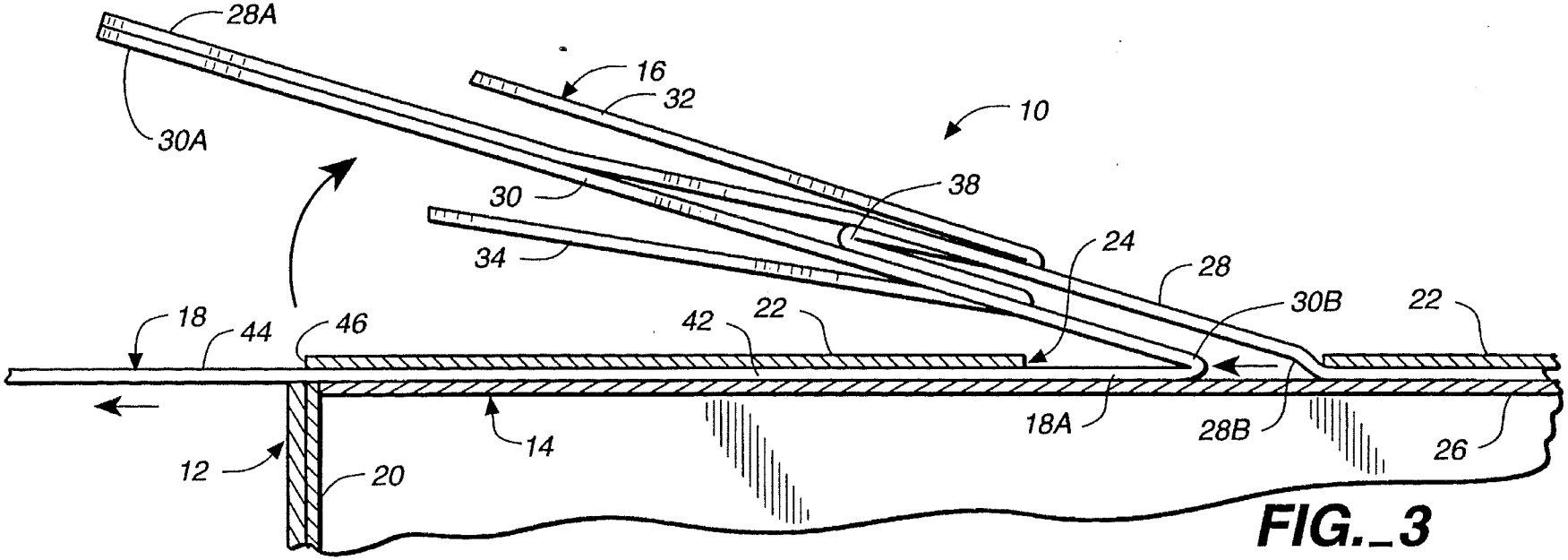
FIG. 3 is an enlarged, side elevational view of the decorative assembly shown in the process of being moved from the folded condition of FIG. 2 to the erected condition of FIG. 1.

Referring to FIGS. 1–3 and 5, the support panel 14 of the assembly 10 is hingedly attached along one edge 14A to a body 12A of the container 12 and has a flap 20 (FIG. 5) attached along an opposite edge 14B which is tucked into the top opening 12B of the container 12 when the support panel 14 has been pivoted to a closed position relative to the container body 12A, as seen in FIGS. 2 and 3. More particularly, as seen in FIGS. 2 and 3, the support panel 14 of the assembly 10 includes a flat outer portion 22 having an opening preferably in the form of an oblong slot 24 defined therein, and a flat inner portion 26 underlying and extending generally parallel along the flat outer portion 22 and bridging across an underside of the slot 24. The flap 20 is attached to the flat outer portion 22 of the support panel 14.

Referring to FIGS. 1–6, the decorative object 16 of the assembly 10 includes at least a pair of brace members 28, 30 disposed side-by-side and hingedly connected together at respective outer end portions 28A, 30A thereof. The outer end portions 28A, 30A of the brace members 28, 30 are located remote from the support panel 14 when the decorative object 16 is disposed in the erected condition, as seen in FIG. 1. The brace members 28, 30 of the decorative object 16 at respective inner end portions 28B, 30B thereof are connected respectively to the support panel 14 and the actuating push-pull member 18. The inner end portions 28B, 30B of the brace members 28, 30 are located adjacent to the support panel 14. As seen in FIGS. 2 and 3, the inner end portion 28A of the one brace member 28 is connected to the support panel 14 adjacent to one side of the slot 24 by being sandwiched between the outer and inner portions 22, 26 of the support panel 14 and adhesively attached upon the inner portion 26 thereof adjacent to the slot 24. The inner end portion 30A of the other brace member 30 is connected to an inner end portion 18A of push-pull member 18 which extends into and is exposed through the slot 24.

Figure 4:
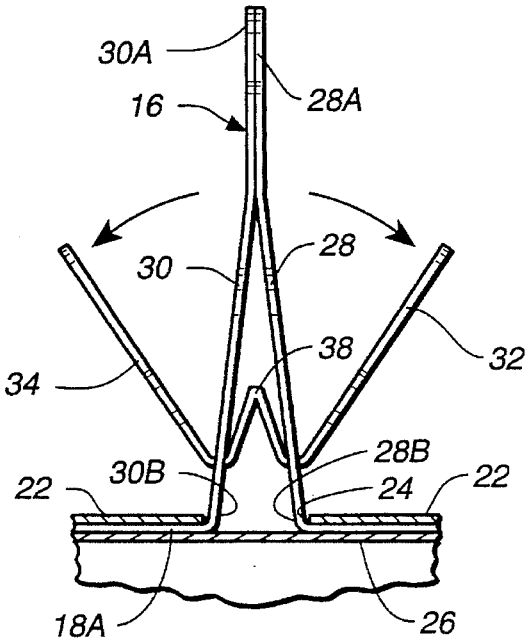
FIG. 4 is an enlarged, front elevational view of the decorative display assembly disposed in the erected condition, as taken along line 4—4 of FIG. 1.

In the illustrated embodiment, by way of example only, the decorative object 16 is a swan. The pair of brace members 28, 30 are configured as the head, neck and body of the swan. A pair of wings 32, 34 provided for the swan object 16 are hingedly connected at fold lines 36 to opposite ends of a connecting web 38 having itself a central fold or hinge line 40. The connecting web 38 is installed through a pair of narrow slots 40 formed in the portions of the brace members 28, 30 defining the body of the swan. The web 38 is adapted to fold up when the object 16 is converted to the folded condition, as seen in FIG. 2. On the other hand, the web 38 is adapted to partly unfold when the object 16 is converted to the erected condition, as seen in FIG. 4.

Referring to FIGS. 1–3, 5 and 6, the elongated push-pull member 1 comprising the actuating member of the assembly 10 includes an elongated main portion 42 extending between the outer and inner portions 22, 26 of the support panel 14 for undergoing sliding movement relative thereto, and a handle portion 44 connected to and constituting an extension of the main portion 42 and extending outwardly from the support panel 14 through a first slit 46 in a peripheral edge portion of the support panel 14. The inner end 18A of the main portion 42 of the member 18 is connected to the inner end portion 30A of the other brace member 30 of the object 16. The terminal end 44A of the handle portion 44 is rounded off and has a pair of ears 48 defined thereon.

When the member 18 is fully extended and the object 16 erected, the handle portion 44 has sufficient length to extend along the opposite sides and the bottom of the body 12A of the container 12 so that the terminal end 44A of the handle portion 44 can be inserted and releasably attached to or locked into a second slit 50 in the opposite peripheral edge portion of the support panel 14 spaced from object 16, as seen in FIG. 1. This not only maintains the decorative display object 16 in an erect condition but also secures the top closure of the container or box in closed condition.

Before use, the body 12A of the container 12 may be in a collapsed configuration (not shown) with the decorative display assembly 10 in a folded condition lying against the collapsed container. To prepare for use, the body 12A of the container 12 is transformed in a known manner to the erected configuration of FIG. 1 and the push-pull member 18 is actuated by being slidably moved to convert the decorative display assembly 10 from its folded condition to erected condition. That is, by pulling on the actuating member 18, the other brace member 30 is pivoted away from the one brace member 28 and the decorative display object 16 unfolds or is converted from the folded condition, in which the object 16 rests in a collapsed configuration (FIG. 2) on the support panel 14, to an erected condition, in which the object 16 is expanded and disposed generally upright (FIG. 1), protruding outwardly from the support panel 14.

Once erection of the decorative display assembly 10 has been accomplished, the actuating member 18 can be extended and retained about the body 12A of the container 12 as described above to keep the container closed and decorative object 16 erect. On the other hand, by pushing on the actuating member 18 in the opposite direction, the decorative object 16 can be converted from the erected condition back to the folded condition and the container can be opened.

FIGS. 7–10, inclusive, illustrate an alternative embodiment of the invention wherein the container incorporating the present invention includes a container body 112. The container or box 112 is essentially the same as container 12 described above except that it includes a supplemental cover 114 not only over folded decorative object 116 but also over the support panel or closure 118 of the container.

Figure 10:
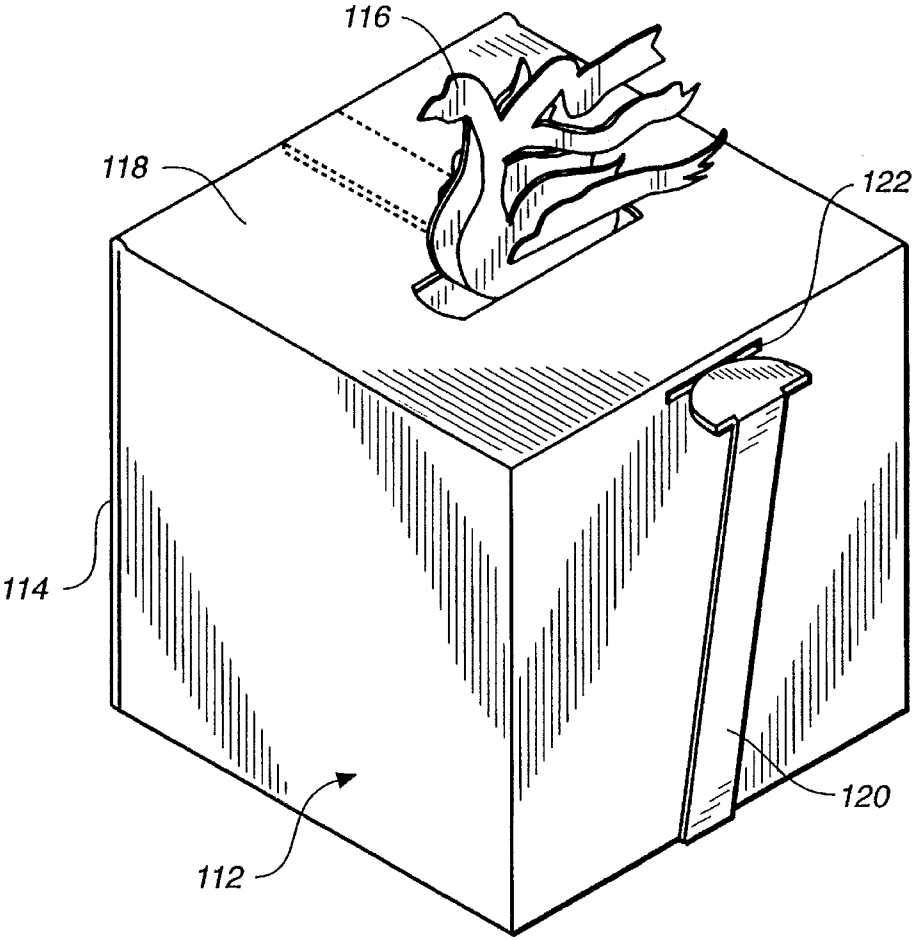
FIGS. 7, 8, 9 and 10 are perspective views of an alternative embodiment of the invention in various stages of use.
Figure 7:
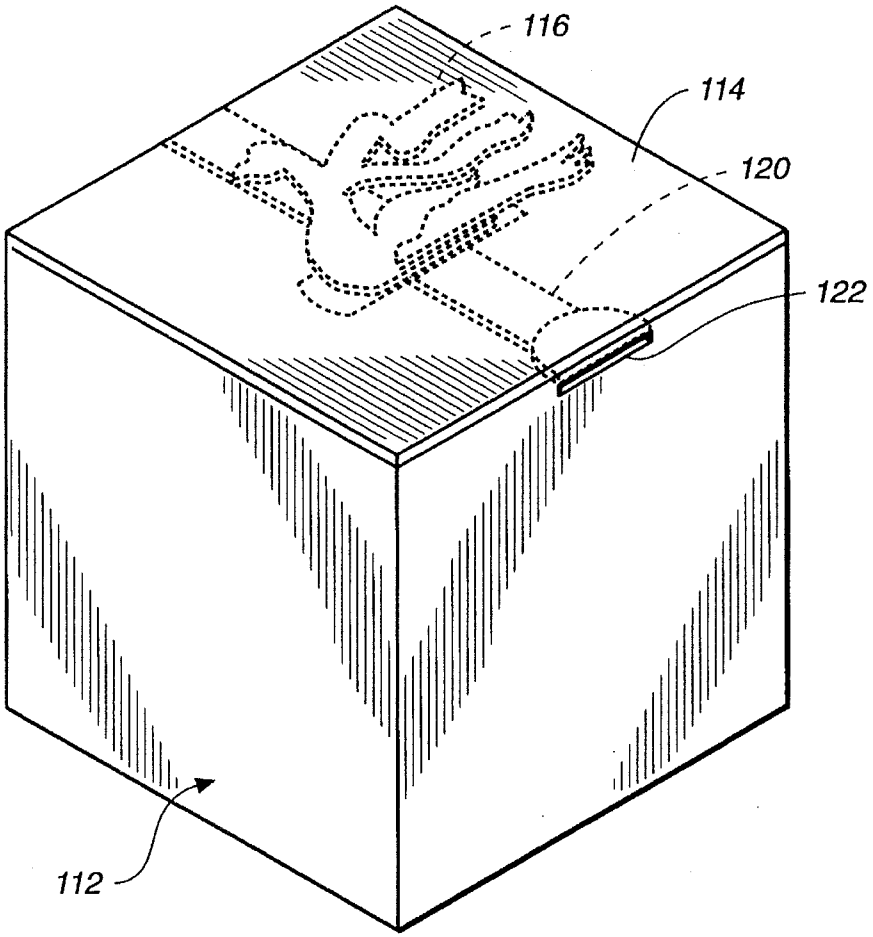
Figure 8:
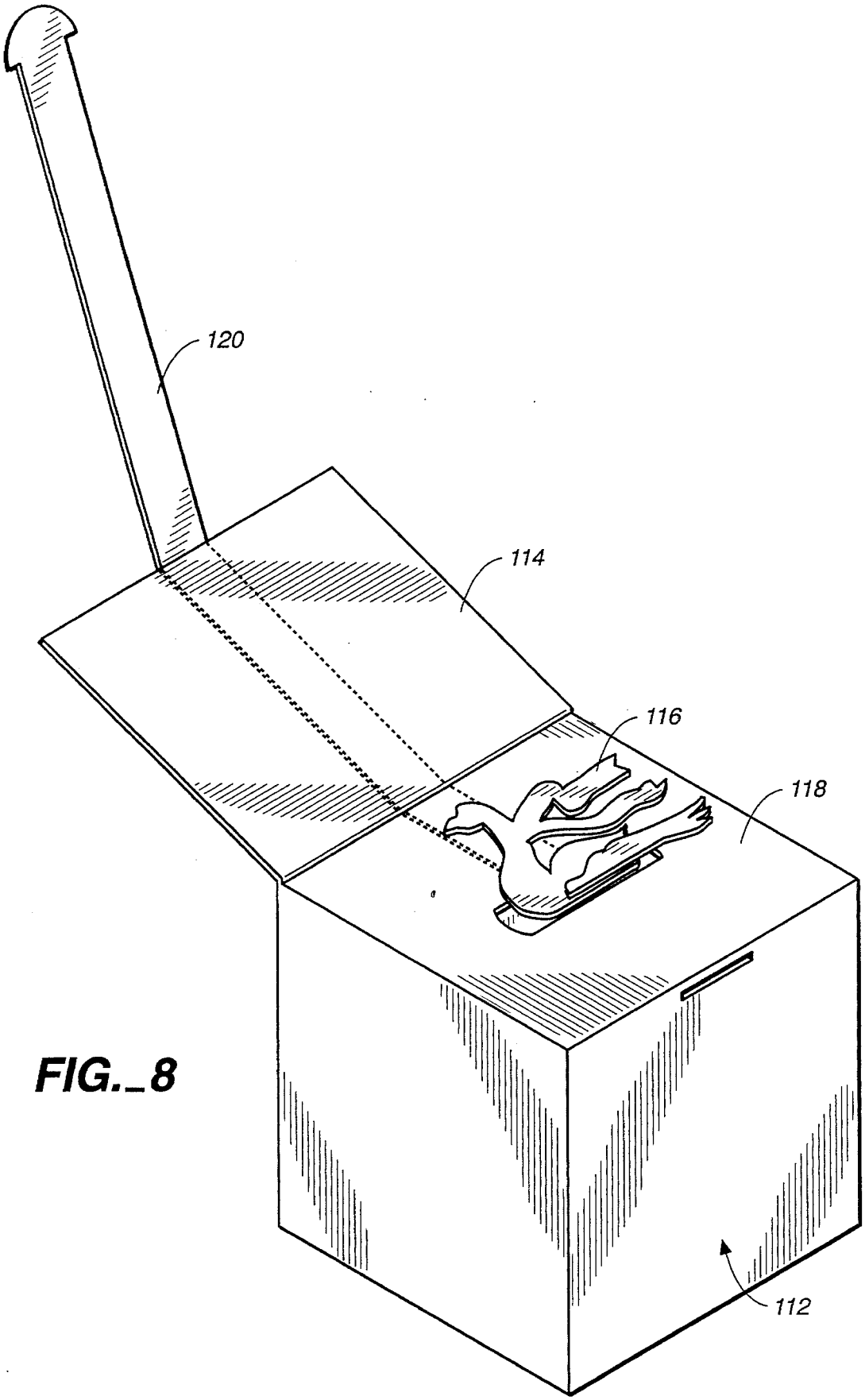
Figure 9:
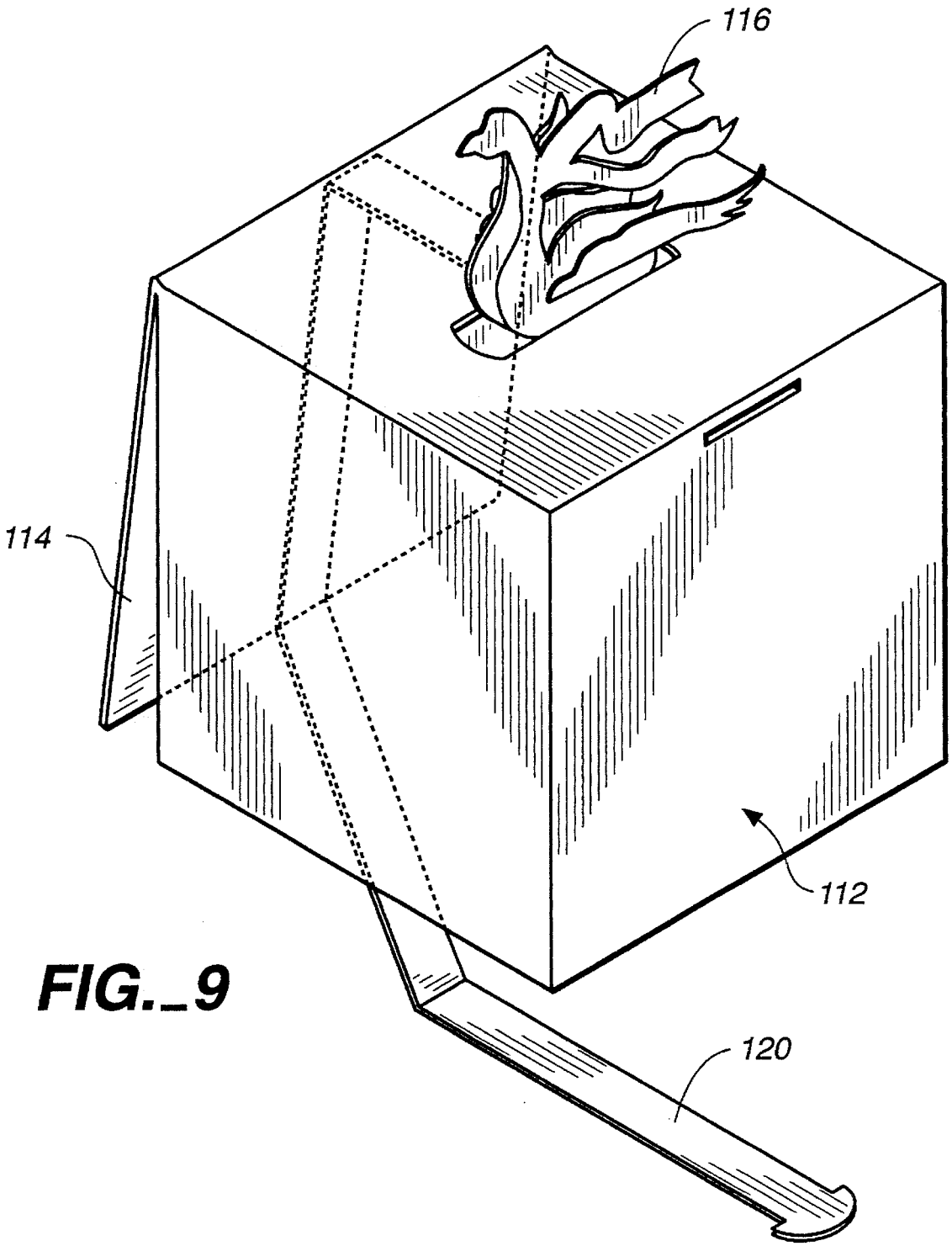

The push-pull member 120 passes through not only the closure 118 but also the supplemental cover 114. The protective or supplemental cover 114 is in the position shown in FIG. 7 when the container is being shipped. When it is desired to open the container, the hingedly attached supplemental cover 114 is opened as shown in FIG. 8 and brought into engagement with a side wall of the container as illustrated in FIGS. 9 and 10. The push-pull member 120 has, of course, been pulled to erect the decorative object 116. The distal end of the push-pull member 120 having the attachment tab is inserted into a slit 122 formed in the side of the container opposed to the side in registry with supplemental cover 114. This will serve to maintain the decorative object in an erect condition as well as to secure closure 118 in position as previously described.

Figure 12:
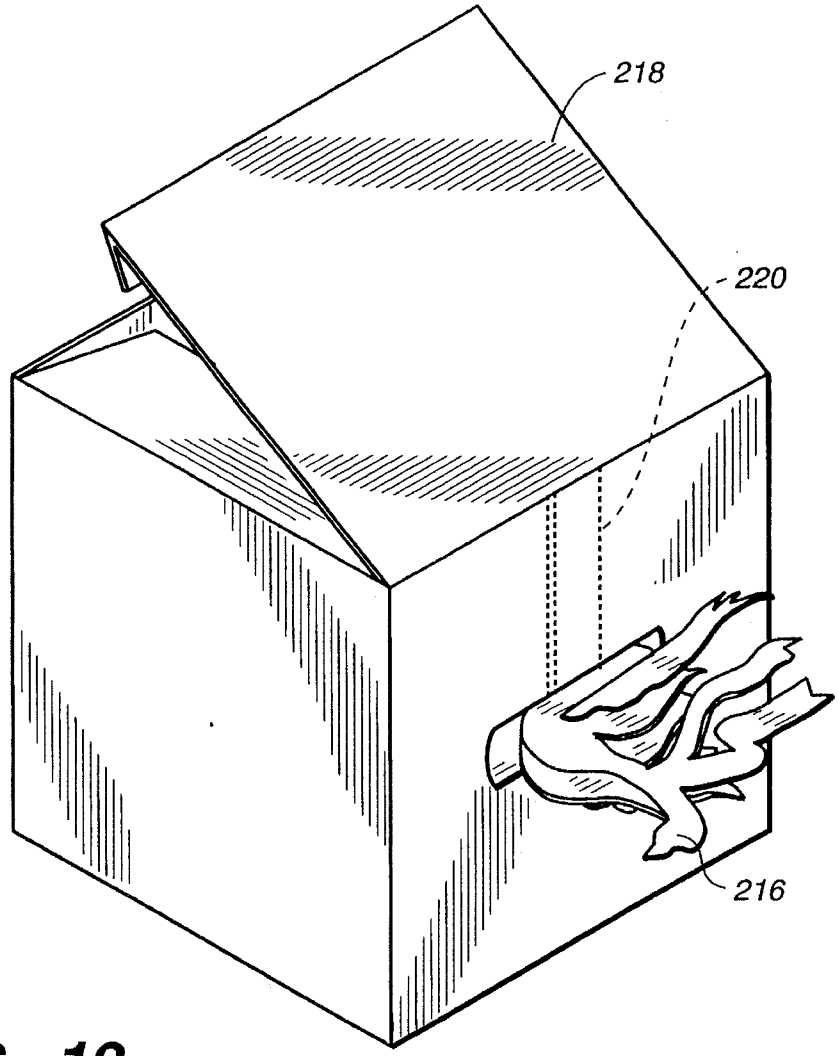
FIGS. 11, 12 and 13 are perspective views of another embodiment of the invention in various stages of use.
Figure 11:
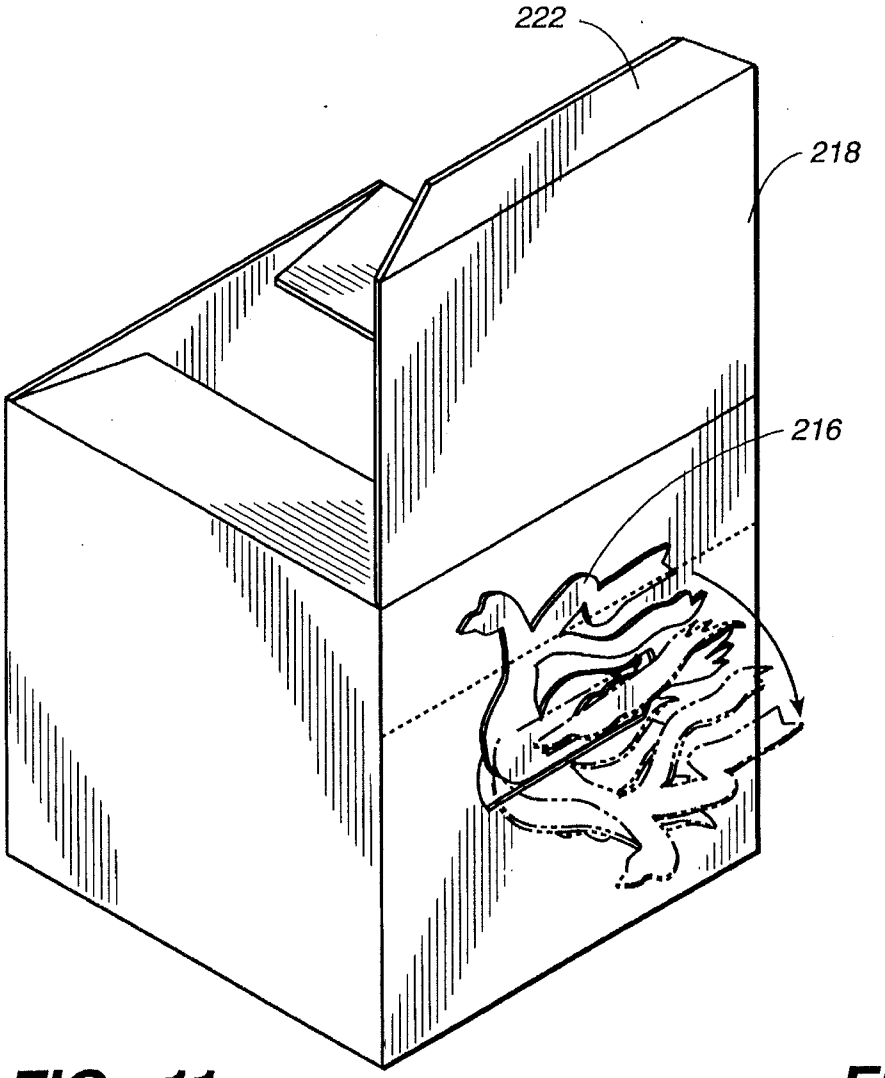
Figure 13:
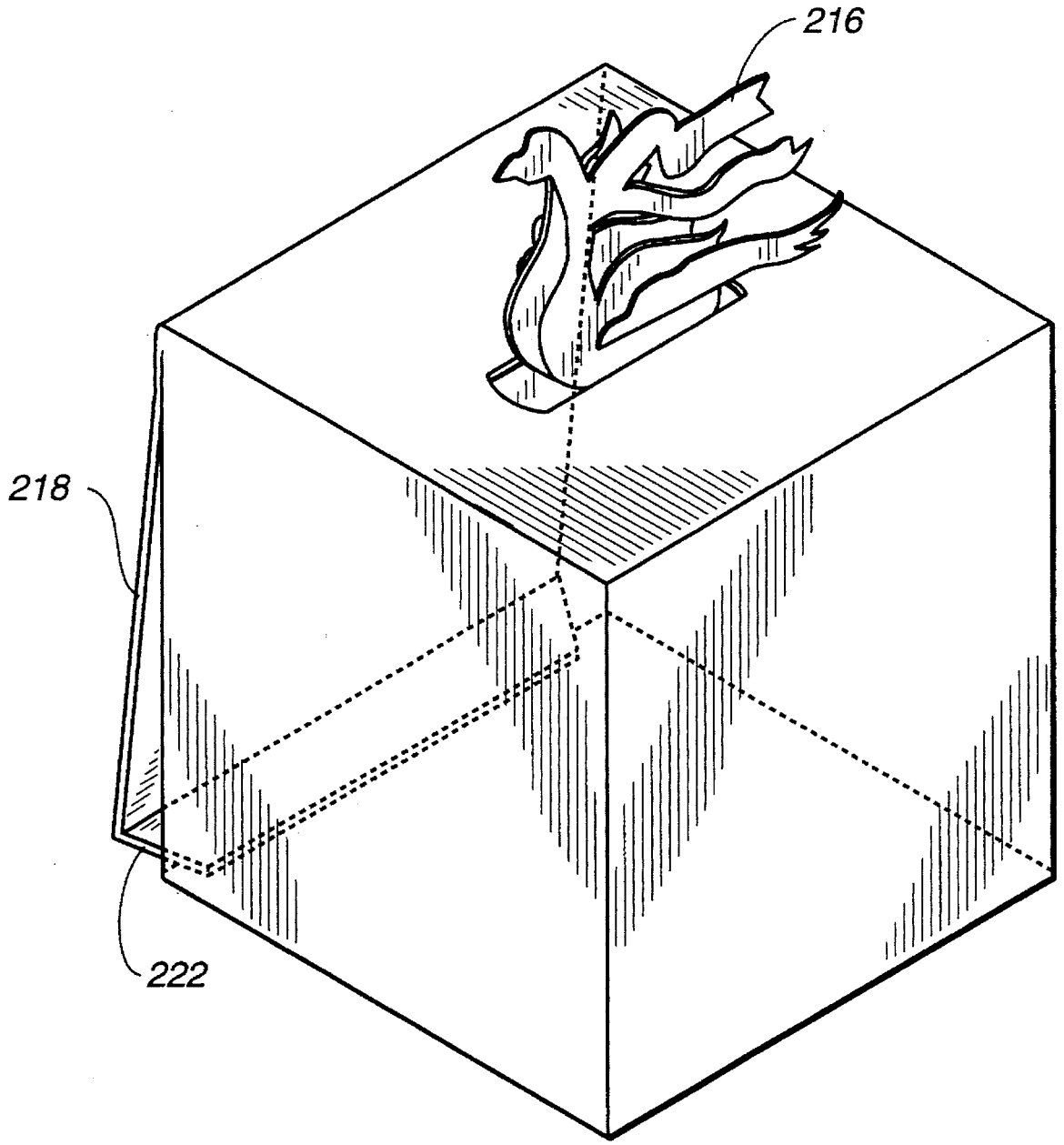

Referring now to FIGS. 11, 12 and 13, in this alternate arrangement, the support panel or closure 218 comprises a portion of the push-pull member 220. That is, the closure 218 may be pulled away from the rest of the container and is in cooperative relationship with the decorative object 216 so that it will pull the decorative object 216 to the erected position.

Once the closure 118 has been extended and the decorative object 216 erected, the outer flap 222 of the closure may be locked into position on the remainder of the container, for example by entering a slit formed in the container at a location spaced from the decorative object 216 to maintain the closure closed and the decorative object 216 erected. See FIG. 13 in this connection.

Figure 14:
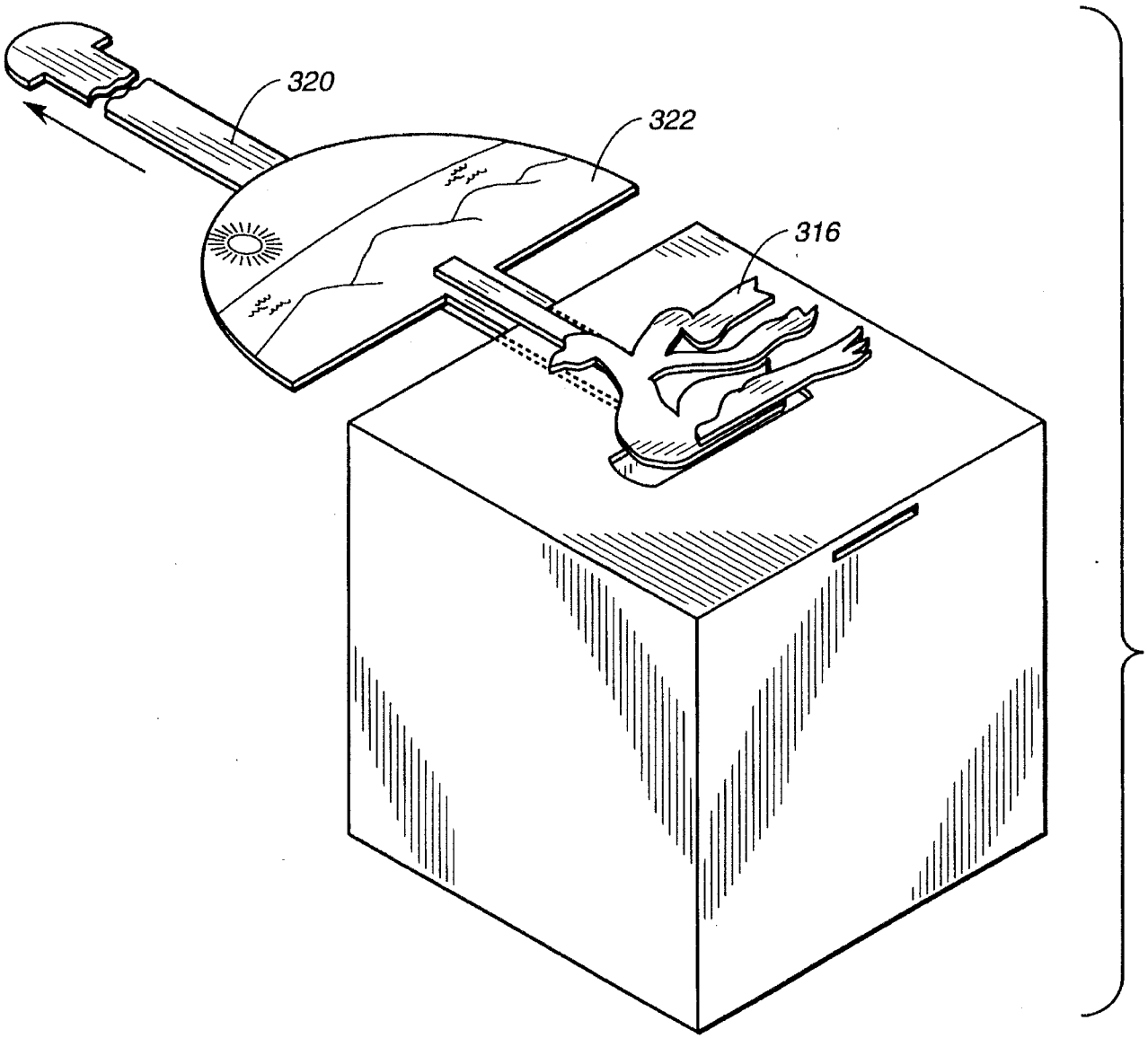
FIGS. 14, 15 and 16 disclose yet one more alternative embodiment of the invention.
Figure 15:
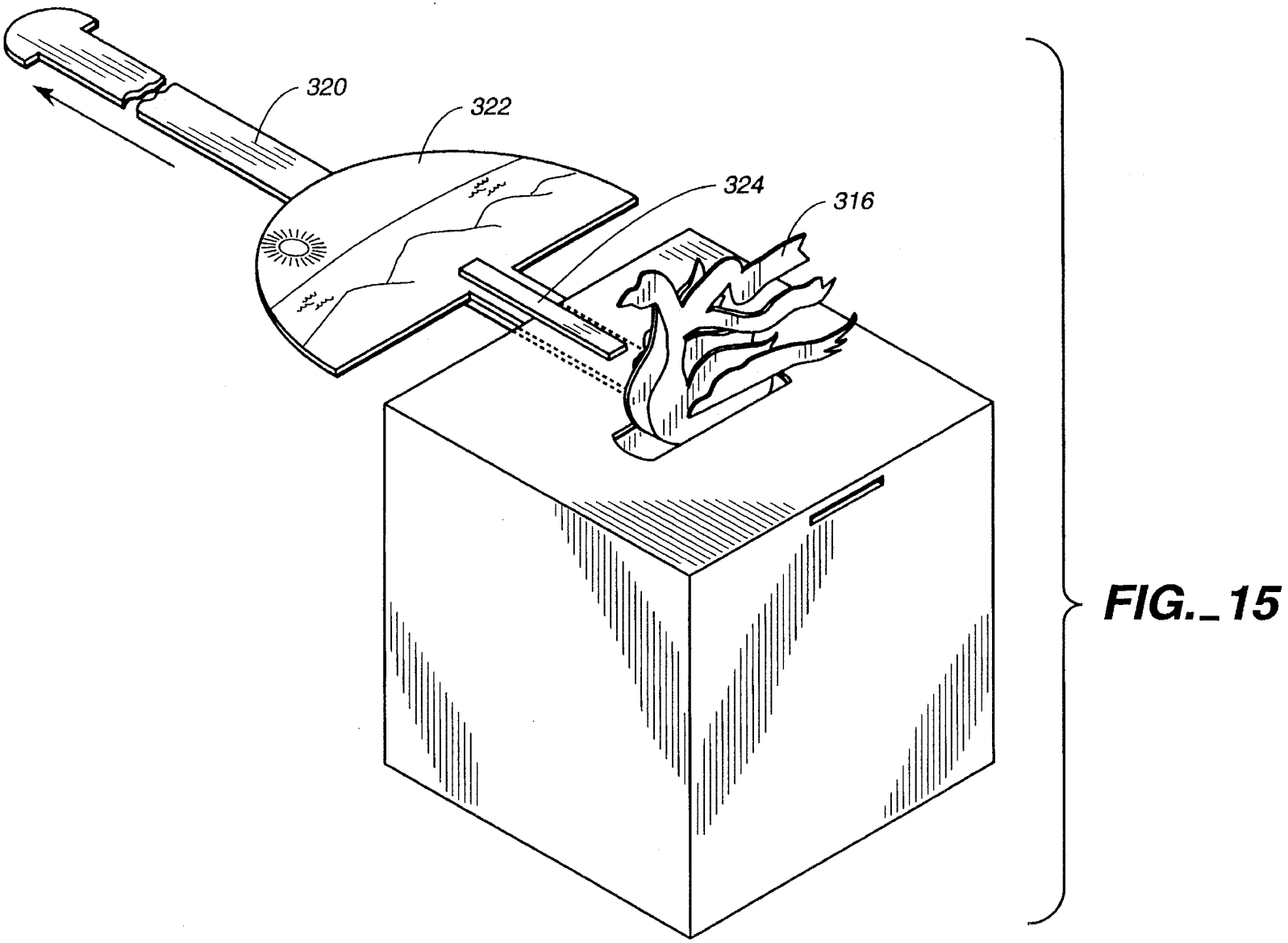
Figure 16:
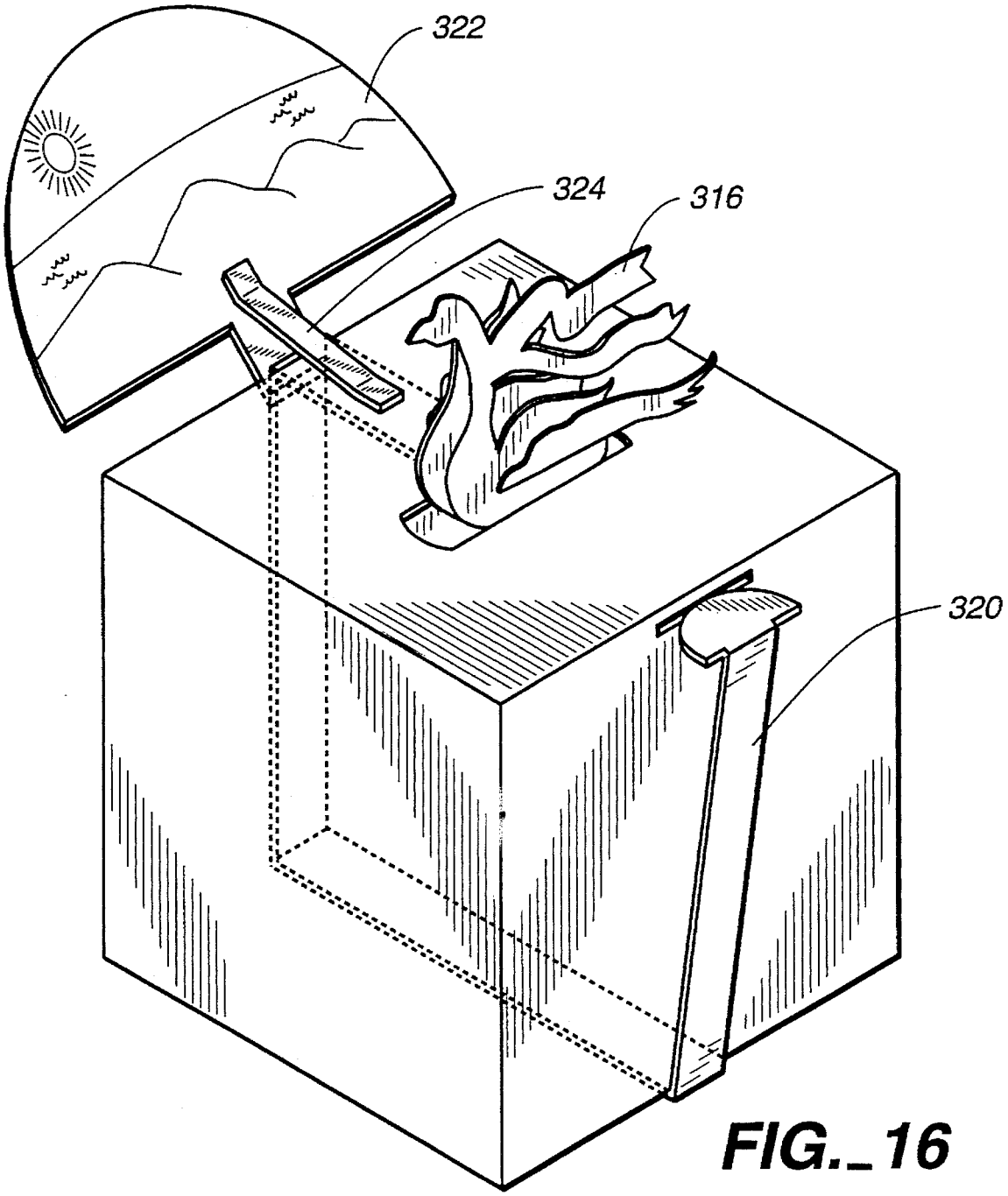

FIGS. 14, 15 and 16 show yet another embodiment of the apparatus. In this arrangement, the push-pull member 320 has attached thereto a supplemental decorative object comprising a panel 322.

When the push-pull member 320 is pulled, the panel 322, which is foldably connected to the member 320 along a hinge, will move to an erected position (shown in FIG. 16) adjacent to decorative object 316. A connector element 324 interconnects the panel 322 with the container closure or top and will bring the panel 322 to its erected condition as the lower portion of the panel is pulled downwardly along side the box by the member 320.

I claim:

1. In combination:

a container having a closure selectively movable between an open position and a closed position; and a decorative display assembly on said container, said decorative display assembly including a support, a decorative object mounted on said support for undergoing movement between folded and erected conditions relative to said support, and an actuating member connected to said decorative object and mounted for movement relative to said support to cause movement of said decorative object between said folded and erected conditions relative to said support, said support including an outer portion having a slot defined therein and an inner portion underlying and extending generally along said outer portion.

2. The combination of claim 1 additionally including attachment means for attaching said actuating member to said container at an attachment location spaced from said decorative object to maintain said decorative object in erected condition, said actuating member being in operative association with the closure of said container to maintain said closure in closed position when said actuating member is attached to said container at said attachment location by said attachment means.

3. The combination of claim 1 wherein said inner portion of said support extends below and along an inner side of said slot defined in said outer portion so as to define a closure portion of said container.

4. The combination of claim 1 wherein said decorative object includes at least a pair of brace members connected together at respective outer portions thereof disposed remote from said support and connected respectively to said support and said actuating member at inner portions thereof disposed adjacent to said support.

5. The combination of claim 4 wherein said inner portion of a first of said brace members of said decorative object is connected to said support adjacent to said slot.

6. The combination of claim 5 wherein said inner portion of a second of said brace members of said decorative object is connected to an end portion of said actuating member extending into said slot.

7. The combination of claim 1 wherein said actuating member includes an elongated push-pull member extending between said outer and inner portions of said support for undergoing sliding movement relative thereto.

8. The combination of claim 7 wherein said actuating member also includes a handle member connected to said main member and extending outwardly from between said outer and inner portions of said support through an opening in a peripheral edge portion of said support.

9. The combination of claim 7 wherein said actuating member is operable to be pulled relative to said support and slidably move in a first direction to convert said decorative object from said folded condition to said erected condition.

10. The combination of claim 7 wherein said actuating member is operable to be pushed relative to said support and slidably move in a second direction opposite from said first direction to convert said decorative object from said erected condition to said folded condition.

11. The combination of claim 1 wherein said decorative object includes at least a pair of brace members connected together at respective outer portions thereof disposed remote from said support and connected respectively to said support and said actuating member at inner portions thereof disposed adjacent to said support.

12. The combination of claim 7 wherein said supplemental cover at least partially comprises said actuating member.

13. The combination of claim 12 wherein said container includes a side wall, said supplemental cover when in said second position being in at least partial registry with said side wall.

14. The combination according to claim 1 additionally comprising a supplemental decorative object in operative association with said decorative object and with said actuating member, said supplemental decorative object being movable to a display position spaced from said decorative object from a non-display position when said decorative object is moved from said folded condition to said erected condition relative to said support by said actuating member.

15. The combination according to claim 14 wherein said supplemental decorative object is a decorative panel.

16. In combination:

a container having a closure selectively movable between an open position and a closed position;

a decorative display assembly on said container, said decorative display assembly including a support, a decorative object mounted on said support for undergoing movement between folded and erected conditions relative to said support, and an actuating member connected to said decorative object and mounted for movement relative to said support to cause movement of said decorative object between said folded and erected conditions relative to said support; and a supplemental cover on said container movable between a first position wherein said supplemental cover covers said decorative object and said support when said decorative object is in folded condition and a second position wherein said decorative object and said support are uncovered by said supplemental cover.

* * * * *